US005333425A

United States Patent [19]

Nickerson et al.

[11] Patent Number: 5,333,425

[45] Date of Patent: Aug. 2, 1994

[54] TENSION MEMBRANE STRUCTURE WRINKLE ELIMINATION

[75] Inventors: David C. Nickerson, Sanford, Me.; Gregory Parker, Huntington Beach, Calif.

[73] Assignee: Rubb, Inc., Sanford, Me.

[21] Appl. No.: 1,439

[22] Filed: Jan. 7, 1993

[51] Int. Cl.[5] ..... E04B 1/12

[52] U.S. Cl. ..... 52/222; 52/273; 52/63; 160/383; 160/392; 160/395

[58] Field of Search ..... 52/222, 273, 63; 160/383, 392, 395

[56] References Cited

U.S. PATENT DOCUMENTS

| | | | |
|---|---|---|---|
| 2,296,782 | 9/1942 | Fisher et al. | 160/383 |
| 4,035,968 | 7/1977 | Caspar et al. . | |
| 4,036,244 | 7/1977 | Huddle . | |
| 4,096,669 | 6/1978 | Pabst . | |
| 4,137,687 | 2/1979 | Sprung . | |
| 4,192,112 | 3/1980 | Reilly, Sr. | 52/222 |
| 4,214,411 | 7/1980 | Pickett | 52/222 |
| 4,229,914 | 10/1980 | Lucas . | |
| 4,259,819 | 4/1981 | Wemyss . | |
| 4,364,206 | 12/1982 | Wybauw . | |
| 4,398,376 | 8/1983 | Fraioli . | |
| 4,534,145 | 8/1985 | Yang et al. . | |
| 4,583,331 | 4/1986 | Hunt et al. . | |
| 4,731,960 | 3/1988 | Sease | 160/392 |
| 4,817,655 | 4/1989 | Brooks | 52/222 |
| 4,841,699 | 6/1989 | Wilson et al. . | |
| 4,879,848 | 11/1989 | Gardner et al. . | |
| 4,885,877 | 12/1989 | Hunt et al. . | |
| 4,894,960 | 1/1990 | Hill et al. | 52/222 |
| 4,926,605 | 5/1990 | Milliken et al. . | |

*Primary Examiner*—Carl D. Friedman
*Assistant Examiner*—Christopher Todd Kent
*Attorney, Agent, or Firm*—John L. Gray

[57] ABSTRACT

A construction system comprising a method and an article employed in said method which is used to engage the edge of adjacent membranes along the top of a beam constituting an arch in a tension membrane structure and pull the membranes toward each other by tightening alternate bolts attached to the beam and the edge of the membrane.

6 Claims, 2 Drawing Sheets

TENSION MEMBRANE STRUCTURE WRINKLE ELIMINATION

BACKGROUND

Tension membrane structures are used throughout the world for a variety of purposes. One obvious and major use is the rapid deployment of buildings and shelters for military applications. However, these structures are also used for a variety of warehousing, environmental, construction and other applications where protection is needed and where the structure may be readily disassembled and moved. Such structures consist of a membrane which is deployed over a framework. The framework oftentimes consists of a series of conventional I-beams or other structural members in the form of an arch covering a span and placed on accompanying supports, the number of arches determining the length of the building being constructed. In order to eliminate wrinkles in the membrane that covers the structural framework, the membrane is pulled down where it engages the ground at the ends of the arches and is held in place by a variety of well-known means. However, this does not eliminate sagging and wrinkling along the length of the building between the membrane panels and between successive arches.

A number of solutions have been advanced to correct this problem. One uses a catenary cable system which pulls the fabric down and inward. However, this produces a saddle shape in the fabric and leaves an area below the catenary cable which remains loose. Another approach is to use an inflatable rib in each panel which tightens the fabric as it is inflated. The problem with this approach is that the inflatable rib inevitably over time will deflate.

Another solution to the problem is to push the structural arches apart using spreader beams. This "prestressing" approach has several drawbacks in that the fabric width tolerances are small and it is difficult to replace damaged panels. Another drawback is that the building foot plates cannot be securely fixed until the fabric is tensioned.

SUMMARY OF THE INVENTION

Applicant's invention eliminates these problems by providing a building system, a method and an article which may be used to pull the membrane tightly between adjacent I-beam or truss arches and eliminate or minimize any wrinkles that might occur.

It is therefore an object of this invention to provide a method and an apparatus for eliminating the wrinkles in the membranes between the structural arches in a tension membrane structure.

It is a further object of this invention to provide such a method, apparatus and a building system which is easy to install, which is weatherproof and which will maintain the condition of the membranes over a period of time, through post tensioning after finished assembly of the structural frame.

These, together with other objects and advantages of the invention, will become more readily apparent to those skilled in the art when the following general statements and descriptions are read in the light of the appended drawings.

DETAILED DESCRIPTION OF THE INVENTION

Figure 1:
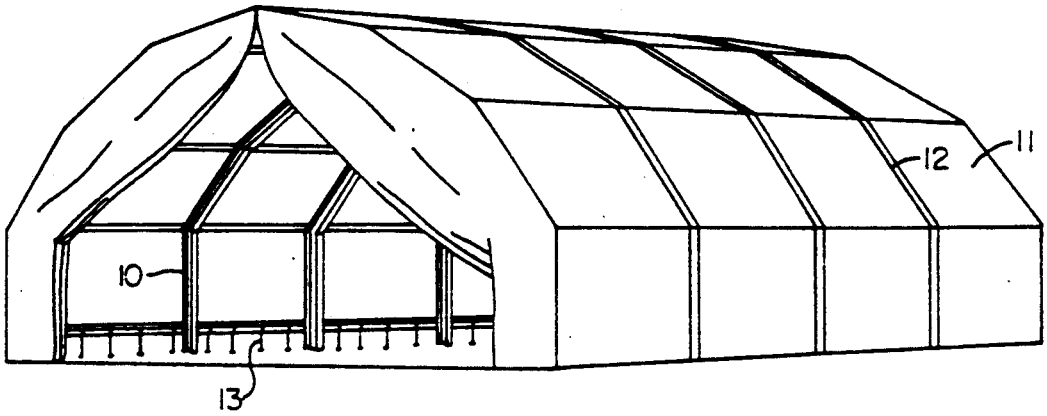
FIG. 1 is a perspective view of a tension membrane structure showing the general configuration of the structure.

Referring now more particularly to FIG. 1, it will be seen that the structural members shown generally at 10 extend in an arch-like fashion from one side to the other of the structure. Covering these structural members 10 are the membrane sections 11 which are of a size such that they must be secured to individual structural members 12. The membrane sections 11 extend from one side of the structure to the other side over the top of the structure and may be pulled down at ground level by means shown generally at 13 so that there are no wrinkles in connection with the span of the membrane.

Figure 2:
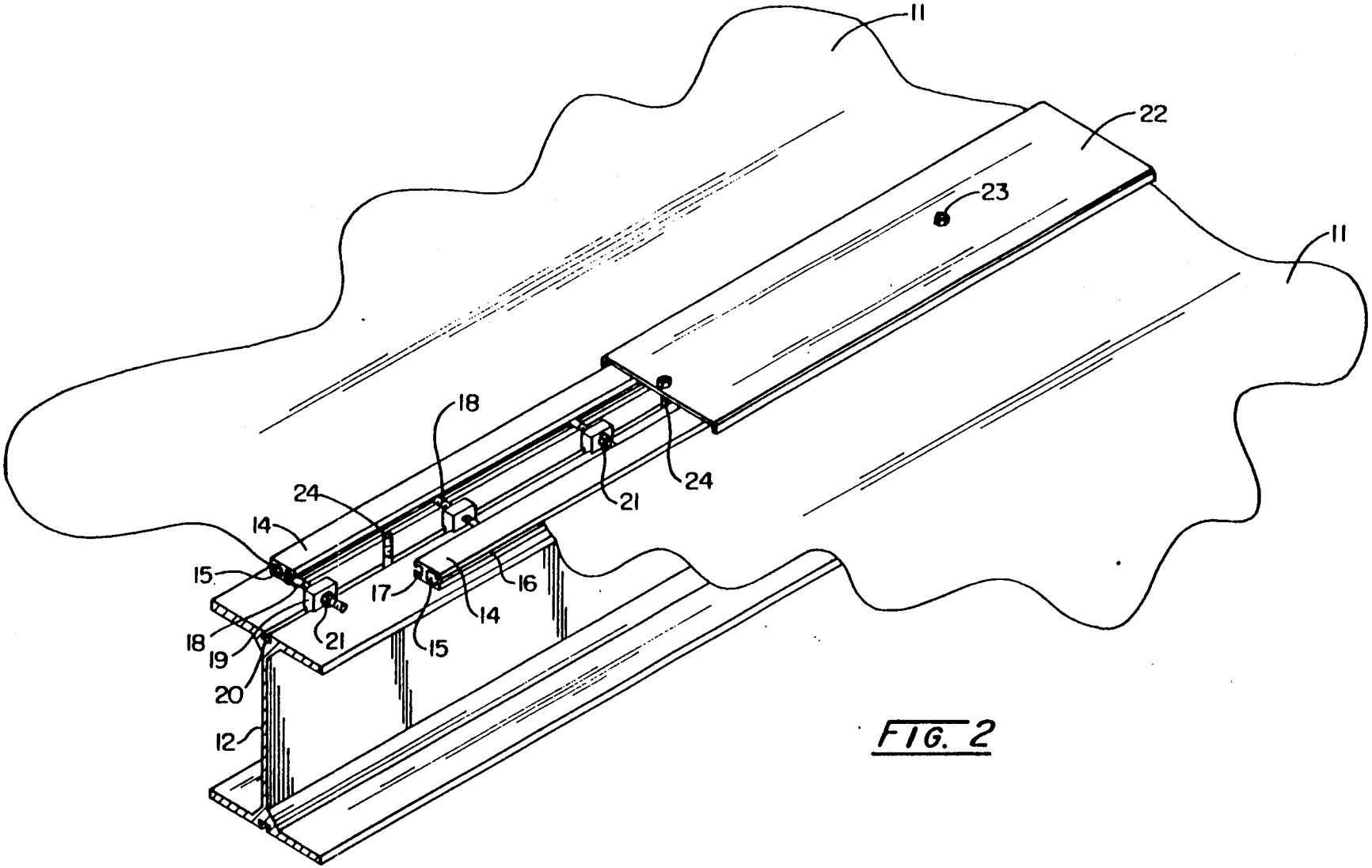
FIG. 2 is perspective view of applicant's invention showing it attached to adjacent membranes along an I-beam constituting a portion of the arch extending across the span of the building.

Referring now more particularly to FIG. 2 which is a perspective view of a detail of the attachment of two adjacent membranes 11—11 to a beam 12, it will be seen that there are oppositely disposed guides 14—14 which are provided with channels 15—15 equipped with slots **15*a*—15*a* which permit an enlarged portion at 16 of the edge of the membrane 11, usually holding a rope or a cable which is part of the edge of the membrane 11, to hold the membrane 11 fixedly in the oppositely disposed guides 14—14. It will be seen that the oppositely disposed guides 14—14 are also provided with a channel 17 which is adapted to engage the head of a bolt 18. This bolt 18 in turn is threadedly engaged by a seat 19 which in turn is held slidably in the channel 20 of the horizontally extending beam 12. It will be noted that the bolts 18—18 are alternatively engaged in oppositely disposed guides 14—14 and as the nuts 21 are tightened, the net result is to draw the oppositely disposed guides 14—14 toward the center of the horizontally extending beam 12. Once all of the wrinkles have been eliminated from the membranes 11—11 a cover 22 may be attached over the horizontally extending beam 12 by means of nuts 23 and bolts 24** to prevent any leakage into the interior of the structure.

Figure 3:
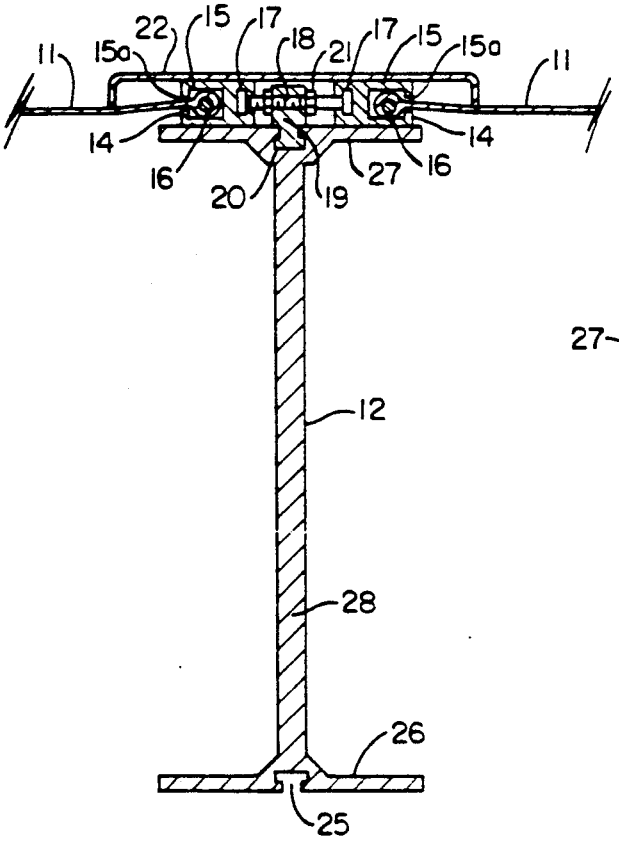
FIG. 3 is a cross section of applicant's invention as shown in FIG. 2 showing two successive elements of applicant's invention.

Referring now more particularly to FIG. 3 it will be seen exactly how these various parts engage one another. It will be noted that the lower end of the horizontally extending beam 12 is also provided with a T slot 25 which may be used to hold an inner liner, if desired, and may also be used to support lights or other apparatus that needs to be suspended from the ceiling.

Figure 4:
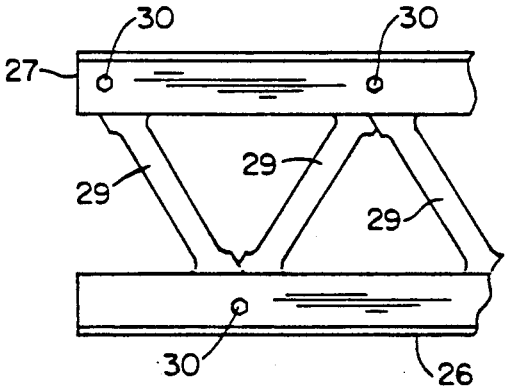
FIG. 4 is an alternative truss structure of the structural supporting member shown in FIG. 3.

Referring now more particularly to FIG. 4 it will be seen that the lower portion 26 of the I-beam 12 and the upper portion 27 of the I-beam 12 may be separated from the center section 28 and replaced with struts 29-29 engaging the lower portion 26 of I-beam 12 and upper portion 27 of I-beam 12 by means of structural bolts 30—30, thus eliminating considerable weight. The lower portion 26 of the I-beam 12 and upper portion 27 of the I-beam 12 function exactly the same way as shown in FIGS. 2 and 3, but the additional structure is much lighter than a conventionally shaped I-beam.

In practicing applicant's invention, the nuts 21—21 are tightened on the bolts 18—18 drawing oppositely disposed guides 14 toward the center of the horizontal structure 12 and thus eliminating any wrinkles in the membranes 11—11 that would exist between horizontal structures 12—12. Once the wrinkles have been eliminated, then the cover 22 is attached thereover.

While this invention has been described in its preferred embodiment, it is to be appreciated that variations therefrom may be made without departing from the true scope and spirit of the invention.

What is claimed is:

1. A construction system for a tension membrane structure provided with a plurality of semi-elastic membranes adjacent to each other, and comprising at least one structural member whose length is greater than said structural member's width and which has a side extending along the length of said structural member comprising two oppositely disposed substantially parallel edges and a centrally disposed slot extending along said side, an adjustable membrane support positioned on said side of said structural member between one edge thereof and said centrally disposed slot, said adjustable membrane support having a portion adapted to support and hold the side of a membrane section which is positioned adjacent to a side of said structural member, and said support being provided with adjustable means to draw that portion of said membrane support which is supporting and holding the side of said membrane section toward, but not into, said centrally disposed slot in said structural member between said structural member's two sides so that said membrane section will become tightened and wrinkles therein will be minimized or eliminated.

2. The construction system of claim 1 wherein said adjustable membrane support comprises at one side a channel adapted to engage an enlarged portion of said membrane at the side thereof and an oppositely positioned channel at the other side of said adjustable membrane support adapted to engage a threaded bolt.

3. The construction system of claim 1 wherein said structural member is selected from the group consisting of I-beams and trusses.

4. The construction system of claim 3 wherein the said I-beam has a top and bottom and is provided with centrally disposed horizontally extending slots on the top and the bottom thereof which are in the shape of a T in cross section.

5. The construction system of claim 4 wherein the adjustable means to draw that portion of said support which is supporting and holding the side of said membrane section toward the center slot includes a threaded bolt and nut.

6. The construction system of claim 5 wherein said bolt threadedly engages a member which is slidably positioned in said slot.

* * * * *